United States Patent [19]

Faulhaber

[11] 3,986,426

[45] Oct. 19, 1976

[54] MUSIC SYNTHESIZER

[76] Inventor: Mark Edwin Faulhaber, 2419 Brookshire Road, Chatham, Wilmington, Del. 19810

[22] Filed: Aug. 28, 1975

[21] Appl. No.: 608,806

[52] U.S. Cl. ..... 84/1.23; 84/1.25; 84/1.26; 84/1.27; 84/DIG. 8; 84/DIG. 9; 84/DIG. 19

[51] Int. Cl.[2] ..... G10H 1/06; G10H 5/06

[58] Field of Search ..... 84/1.01, 1.04, 1.06–1.13, 84/1.19–1.27, 454, DIG. 2, DIG. 4, DIG. 5, DIG. 7, DIG. 8, DIG. 9, DIG. 10, DIG. 11, DIG. 18, DIG. 19, DIG. 20, DIG. 23

[56] References Cited

UNITED STATES PATENTS

| | | | |
|---|---|---|---|
| 3,570,357 | 3/1971 | Adachi | 84/1.26 |
| 3,636,231 | 1/1972 | Schrecongost et al. | 84/1.23 |
| 3,786,166 | 1/1974 | Mieda | 84/1.01 |
| 3,828,110 | 8/1974 | Colin | 84/1.01 |
| 3,881,387 | 5/1975 | Kawakami | 84/1.24 |
| 3,886,834 | 6/1975 | Okamoto | 84/1.19 X |
| 3,886,836 | 6/1975 | Hiyoshi | 84/1.26 |
| 3,897,709 | 8/1975 | Hiyoshi et al. | 84/1.19 |
| 3,902,392 | 9/1975 | Nagahama | 84/1.01 |
| 3,902,396 | 9/1975 | Hiyoshi | 84/1.19 |
| 3,922,943 | 12/1975 | Niinomi | 84/1.19 X |

*Primary Examiner*—Stanley J. Witkowski
*Attorney, Agent, or Firm*—Rollin D. Morse

[57] ABSTRACT

A music synthesizer produces pitch-proportional voltages in a novel resistor network, uses these voltage via keyboard control to generate in a voltage-controlled oscillator a high frequency signal, being a multiple of all the harmonic frequencies desired, separates the individual harmonics, converts them to sine waves with voltage-controlled tunable tracking filters, blends the waves in desired proportions, introduces transients of attack, decay, sustain, and release of key into each note, and introduces appropriate vibrato. An alternate apparatus accepts an external signal and converts it to voltages proportional to frequency, whereby accompaniment on pitch, in "close harmony" or more distantly related, is provided.

14 Claims, 7 Drawing Figures

MUSIC SYNTHESIZER

BACKGROUND OF THE INVENTION

The present invention relates to instruments for producing musical sounds by electronic means. In particular, this invention is concerned with instruments of the type which produce sounds by generating voltages or currents corresponding to frequencies and amplitudes of notes played one at a time. This class of instruments, called monophonic synthesizers, is popular for their versatility in musical expression and for the unnatural sounds which they can produce for special effects. The invention is, however, versatile, and may be applied to polyphonic (organ-type) synthesizers.

Most often the monophonic synthesizer contains a keyboard of the organ-type which controls the frequency (pitch) of the note being played; however some synthesizers have provision for external control of frequency and amplitude, such as by electrical signals from a microphone. Since the monophonic synthesizer produces but one note at a time, its design usually contains one main frequency generator which produces a tone at the fundamental frequency of the note struck. Typically this generator is a voltage-controlled oscillator (VCO) designed to provide one or more types of waveforms having rich harmonic content, such as square waves, triangle waves, sawtooth waves, and pulses. Sine waves (pure tones having no harmonics) are usually not produced because it is difficult to generate a low distortion sine wave over a wide frequency range and a single pure tone is musically uninteresting. Thus the variety of tonal qualities (timbres) possible from present synthesizers is limited to those which can be derived from filtering the harmonic-rich VCO outputs. This limitation has been compensated to some degree by developing versatility in voltage envelope and pitch control which cannot be duplicated by other instruments, such as polyphonic organs and conventional wind and string instruments. But even their limited application as musical instruments, present-day synthesizers lack the frequency accuracy and stability necessary for ensemble performances and for the now popular technique of multi-track recording of a single instrument on repeated playing, for an ensemble effect. Further, present techniques for vibrato generation in both organs and synthesizers do not automatically provide for adjusting the vibrato amplitude (frequency swing) according to the note played, thus creating a disparity in aural vibrato effect between low and high notes. Conventional musical instruments, on the other hand are played such that the vibrato represents a nearly constant musical interval about the note being played.

Accordingly, it is an object of this invention to provide an instrument which can produce musical sounds having a wide variety of timbres encompassing those of all known instruments, wind and string, without complex filtering of pulse or ramp waveforms.

It is also an object of this invention to provide an instrument which maintains a preset timbre over the compass of at least five octaves without a corresponding variation in volume.

It is another object of this invention to provide keyboard control of fundamental pitch and prevent simultaneous key depressions from deleteriously affecting instrument output, while using a single switch contact for each key.

It is another object of this invention to provide an instrument having versatile frequency and amplitude envelope control at high signal levels without introducing appreciable distortion.

It is yet another object of this invention to provide an instrument which will accept the electrical signal produced by an external agency, separate frequency and amplitude components, and generate sounds of preset timbre whose pitch and volume are proportional to the signal received.

BRIEF DESCRIPTION OF THE DRAWINGS

These and other objects and advantages of this invention will become apparent to those skilled in the art from a description of the invention taken in conjunction with the accompanying drawings of which.

SUMMARY OF THE INVENTION

Process and apparatus are provided that are especially useful for monophonic music synthesis according to the equitempered 12-tone-peroctave musical scale, although also useful with other equitempered scales and with organs using multiple simultaneous tone sources. A voltage-controlled oscillator generates a high frequency that is a multiple of all the harmonic frequencies desired. The high frequency is digitally subdivided into multiple outputs, one at each desired harmonic frequency. The individual outputs are converted to sine waves of each of the harmonic frequencies, using novel tracking filters whose filtration characteristics is tuned to keep "on track" with the frequency of the voltage controlled oscillator, using as control source the same voltage that is fed to oscillator. A novel ladder resistor network is provided to produce individual voltages to be fed by keyboard switching to the oscillator, the voltages being proportional to any preselected equitempered musical interval, commonly the 12 tone-peroctave scale.

Novel logic circuitry is provided to prevent false signalling that would be caused by multiple depression of keys. Novel logic circuitry is also provided to enable control of individual note transients, such as attack, decay, sustain and release of key. Novel vibrato means are also provided for input not from a keyboard but from another source, whereby the source can be accompanied in near-perfect match of pitch, but with different timbre, and/or at different pitch, such as "thirds. " These means develop a pitch-proportional voltage from the signal of the source, and use this voltage to control the frequency of the generated accompaniment, and to develop an amplitude- proportional voltage from the source signal to control the amplitude of the generated accompaniment.

DESCRIPTION OF PREFERRED EMBODIMENTS

Figure 1:
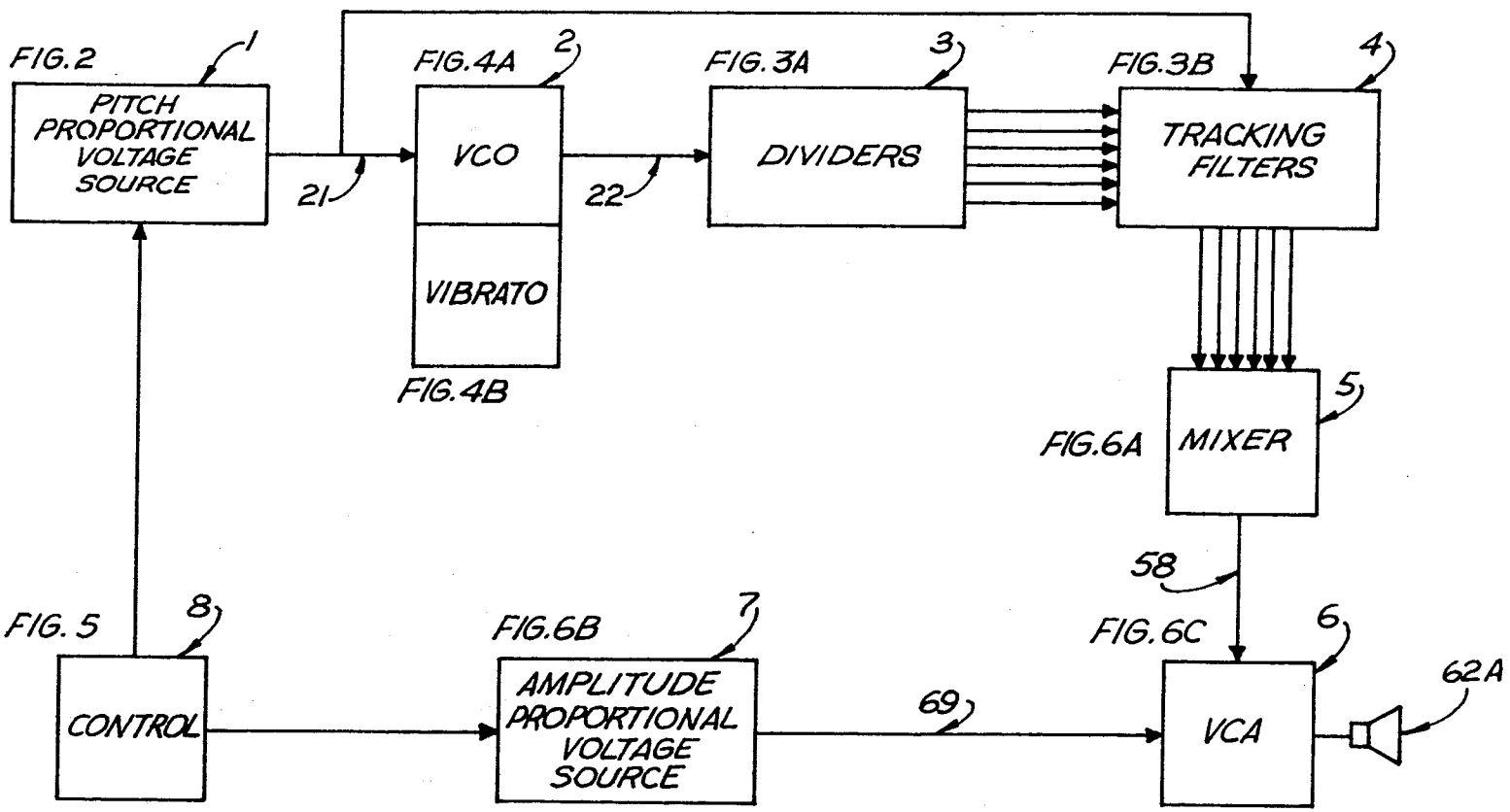
FIG. 1 is a block diagram of the elements comprising this invention showing their arrangement.

Referring specifically to FIG. 1 of the accompanying drawings, there is a series of elements defining the pitch and timbre of the tone comprising a source of voltage, 1, which is proportional to the pitch desired; a voltage-controlled oscillator 2, which produces a train of pulses proportional in frequency to the voltage input via line 21; a digital divider network, 3, which divides the frequency of the VCO output to produce a set of harmonically related square-wave or pulse signals; a set of tracking filters, 4, receiving the said signals and producing low-distortion sine waves, the filter response being controlled by pitch-proportional voltage 21; and a mixing amplifier, 5, which receives the weighted harmonically related sine-wave signals and combines them to produce a complex wave of desired timbre output on line 58. The elements which determine the amplitude of the tone comprise a source of voltage, 7, which is proportional to the amplitude of the tone, output on line 69, and a voltage-controlled amplifier (VCA), 6, which receives the complex timbre signal 58 and modulates its amplitude according to the variation in voltage 69. Both pitch and amplitude voltage sources, 1 and 7 respectively, receive inputs from a control module, 8. Details of these elements are disclosed in the following discussion.

In the discussion of the operation of the invention it is helpful to recall that the aural sense of pitch follows generally a logarithmic function, i.e. the ear responds to pitch changes in uniform manner as the ratio of the pitches. Thus the derivation of the common equitempered 12-tone musical scale conforms to the aural sense of pitch by defining an interval on that scale as a change in pitch of the twelfth root of two times the present value - a ratio of 1.05946 for an increase of one interval, or 0.9439 for a decrease of one interval. Each interval may also be defined in terms of 100 cents. The difference in cents of a pitch of frequency $f_2$ from a reference frequency $f_1$ is equal to 3986 log $$\frac{f2}{f1}.$$

The minimum perceptible pitch change is generally acknowledged to be about 5 cents, an change of 0.3% in frequency.

In the design of keyboard-controlled synthesizers using voltage-controlled oscillators, it is necessary to condition the voltage input to the VCO so that the voltages from the keyboard network conform to the equitempered scale. This arises from the fact that most designs for VCO's are inherently linear, i.e. the frequency output is directly proportional to the voltage input. Conformance to the equitempered scale is presently achieved in either of two ways: (1) By designing the voltage dividing network associated with the keyboard using a different value of precision resistor between each pair of key contacts, or (2) By using a linear dividing network of equal-valued resistors and providing a nonlinear device, e.g. a diode, at the input to the VCO to achieve an approximation to the desired logarithmic function. The first case is accurate, but expensive owing to the multiplicity of resistance values required. The second method is inexpensive, but inaccurate and unstable with changes in temperature.

One improvement of this invention is the design of a resistance network for producing equitempered scale voltages at high precision and stability using just two resistor values plus a terminator value of resistance. A further advantage of my method is that no change in network resistor values is necessary for use with a keyboard of any desired number of notes.

Figure 2:
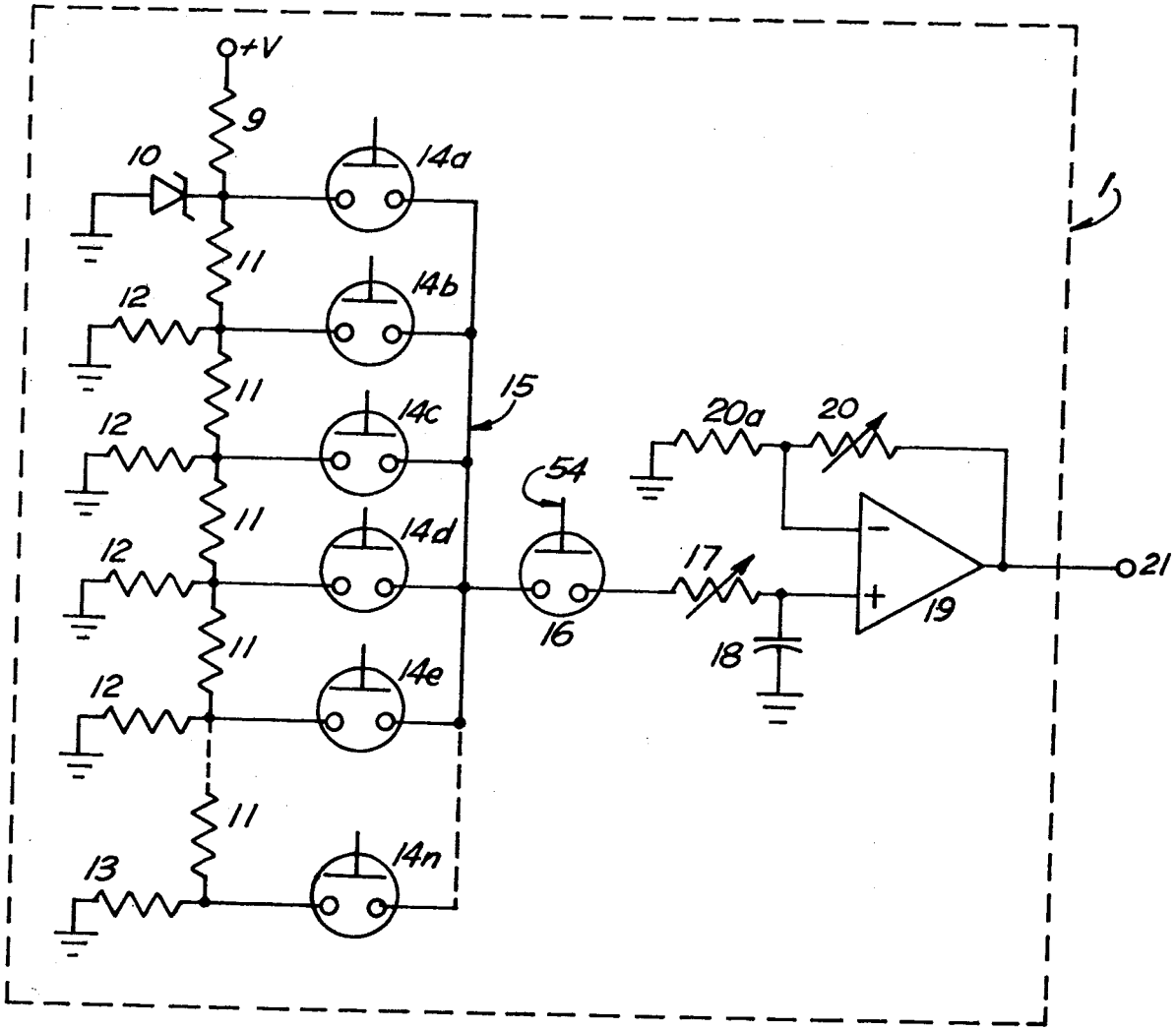
FIG. 2 is a schematic diagram of the circuit means for generating voltages proportional to the relative pitches of the equitempered scale under keyboard control.

FIG. 2 illustrates the improved method. In this case, the pitch-proportional voltage source 1 comprises a ladder attenuator network under keyboard control. The attenuator is supplied with a stable voltage source made up of a source of voltage +V, a current defining resistor 9, and a zener reference diode 10. This voltage source is designed to provide a temperature-independent reference for pitch-proportional voltage. A typical diode 10 might be a type IN3499 having a minimum temperature coefficient when it is supplied with 7.5 ma., defined by +V, resistor 9, and the characteristic impedance of the ladder network connected thereto. The stability of the voltage source is necessary to insure absolute pitch; the relative pitch is assured by the design of the ladder network.

For the most needed case, namely, a network to produce the intervals of the common equitempered 12-note (per octave) musical scale, each step in the ladder network must provide an attenuation of $$1\sqrt{12\ 2} = 0.9439$$

for a decrease of one interval. However, the invention is applicable to any other equitempered scale, using the same design technique but with the required number of notes; for example, if one desired an eleven-note equitempered scale, the attenuation per interval would be $1\sqrt{11\ 2}$, and for an n-note scale, the attenuation per interval would be $1\sqrt{n\ 2}$, (which may be also written as $2^{-1/n}$).

The ladder network comprises a series of L sections, each providing an attenuation of the section input voltage equal to one interval of the desired equitempered scale. I have discovered that a ladder attenuator network using series elements 11 of normalized value 1 and shunt elements 12 of normalized value 299.6 will produce the requisite attenuation between sections provided that the final key section has a shunt resistance 13 of normalized value 16.817.

By way of explanation, (1) the latter resistor 13 of 16.817 normalized value, in series with the adjacent resistor 11 of normalized value 1,000, provides a tap between the two resistors with the desired final attenuation of $$\frac{16.817}{16.817 + 1.000} = 0.9439$$

(2) moving up the ladder one step at a time, it can be calculated that if the shunt have a normalized value 299.6, the attenuation at each step will equal 0.9439.

As a real example for the 12-note equitempered scale, the following values using commercially available resistors are tabulated:

| | | |
|---|---|---|
| +V | | 15 volts |
| Res. | 9 | 1200±5 % ohms |
| | 11 | 1000±0.1 % ohms |
| | 12 | 301±1 % K ohms |
| | 13 | 16.817±0.1 % K ohms |
| | | (15 K ohms fixed, + 2 K ohm |

-continued

| |
|---|
| rheostat) |

A network assembled within the above limits of variation of commercial components upon measurement showed no error greater than ± 4 cents.

Generalizing from the above, an equitempered scale of any desired number, $n$, of notes per octave, will need a ladder network in which the terminating shunt resistor combined with the final series resistor (of preselected normalized resistance of unity) produces the desired attenuation of $1/\sqrt{n\ 2}$, also written $12^{1/n}$:

$R_t/(1 + R_t) = 1/2^{1/n}$, or $R_t = 1/(2^{1/n} - 1)$

The resistor circuit made up of the terminating resistor, $R_t$ and the last series resistor (R=unity) in one arm, in parallel with the last shunt resistor ($R_e$), must supply the same attenuation for the next-to-last step, and since the next-to-last series resistor is also unity, the resistance of the parallel circuit must equal $R_t$:

$$\frac{1}{R_t} = \frac{1}{1 + R_t} + \frac{1}{R_e}$$

whence $R_e = R_t + R_t^2$.

FIG. 2 shows but five sections merely illustrative of the design. The number of sections actually employed would be one fewer than the number of keys on the keyboard, the highest key voltage being taken directly from diode 10.

Switches 14 sample the voltage along the ladder network according to the key depressed. These switches are preferably electronic switches of the field-effect type, being controlled by a voltage derived from the mechanical switches associated with the keyboard itself, detailed in FIG. 5 to be described later. The RCA type CD4016 quad switch is suitable for this application. All output sides of switches 14 are connected to a common bus 15 and to the input side of switch 16. Switch 16 is controlled by control network 8 detailed in FIG. 5 in response to a single key depression described later. The keyboard-selected voltage on bus 15 is sampled by switch 16 and passes to the input of amplifier 19 through an optional RC network comprising variable resistor 17 and capacitor 18. This RC network provides an adjustable portamento (glide) effect, the degree of which is controlled by resistor 17. Amplifier 19 is provided with a gain-determining variable resistance 20 whose purpose is to initially calibrate the voltage output on line 21 for absolute pitch accuracy in combination with the VCO 2 which follows. Resistor 20 may also be adjusted to transpose the voltage 21 from concert pitch equivalence ($A_4$=440 Hz.) to any arbitrary reference pitch, while maintaining equal-tempered scale ratios.

Having established a precision source of pitch-proportional voltage, it remains to use it to obtain a musical sound of preselected timbre. Conventionally this is achieved in synthesizers by generating harmonic-rich waveforms and filtering them to obtain a desired timbre - the "format filtering" principle also used in polyphonic electronic organs. This method generally produces only a limited variety of timbres owing to the rigid relationships among harmonics in the source waveforms and the limitations of filter designs. It is also very difficult to maintain a constant timbre over a wide range in pitch using conventional formant filters.

Another method (the "synthesis" method for timbre definition used in some polyphonic instruments like the Hammond organ) develops sounds of desired timbre by borrowing pure tones from approximately harmonically related key oscillators, weighting these borrowed tones in preselected proportion, and combining them. This method has the disadvantages of: requiring multiple oscillators; using inharmonic tones (e.g. the borrowed fifth harmonic is 14 cents too sharp and the seventh is 31 cents too sharp); and losing the desired harmonic structure in upper registers, there being no higher key oscillators to borrow from. Monophonic music synthesizer designs have avoided the synthesis method for the most part.

The present invention overcomes the limitations of both the formant filtering method and the borrowing synthesis method while maintaining the advantage of completely arbitrary selection of timbre and provides the further advantages of generating low-distortion tones (sinusoids) at exact harmonic relationships having constant amplitude over a wide range in pitch so that their combination will produce a timbre which will be similarly constant over the full compass of the keyboard. These advantages are achieved by generating, via a conventional VCO, a pulse train having a frequency which is an integral (preferably even) multiple of each and every harmonic it is desired to generate, dividing the VCO output with a number of digital binary dividers connected to provide individual outputs at the fundamental pitch and for all desired harmonics, individually filtering each divider output to obtain a substantially sinusoidal signal at the frequency of that output, and combining the sinusoidal harmonic signals in preselected proportion to produce a tone of desired timbre. The filtering means employed in this invention is of the multiple-section low-pass type wherein the frequency-cutoff determining resistances are controlled by the pitch-proportional VCO input voltage such that the filter "tracks" the input frequency, producing an output which is substantially constant in amplitude over a wide frequency range.

Figure 3:
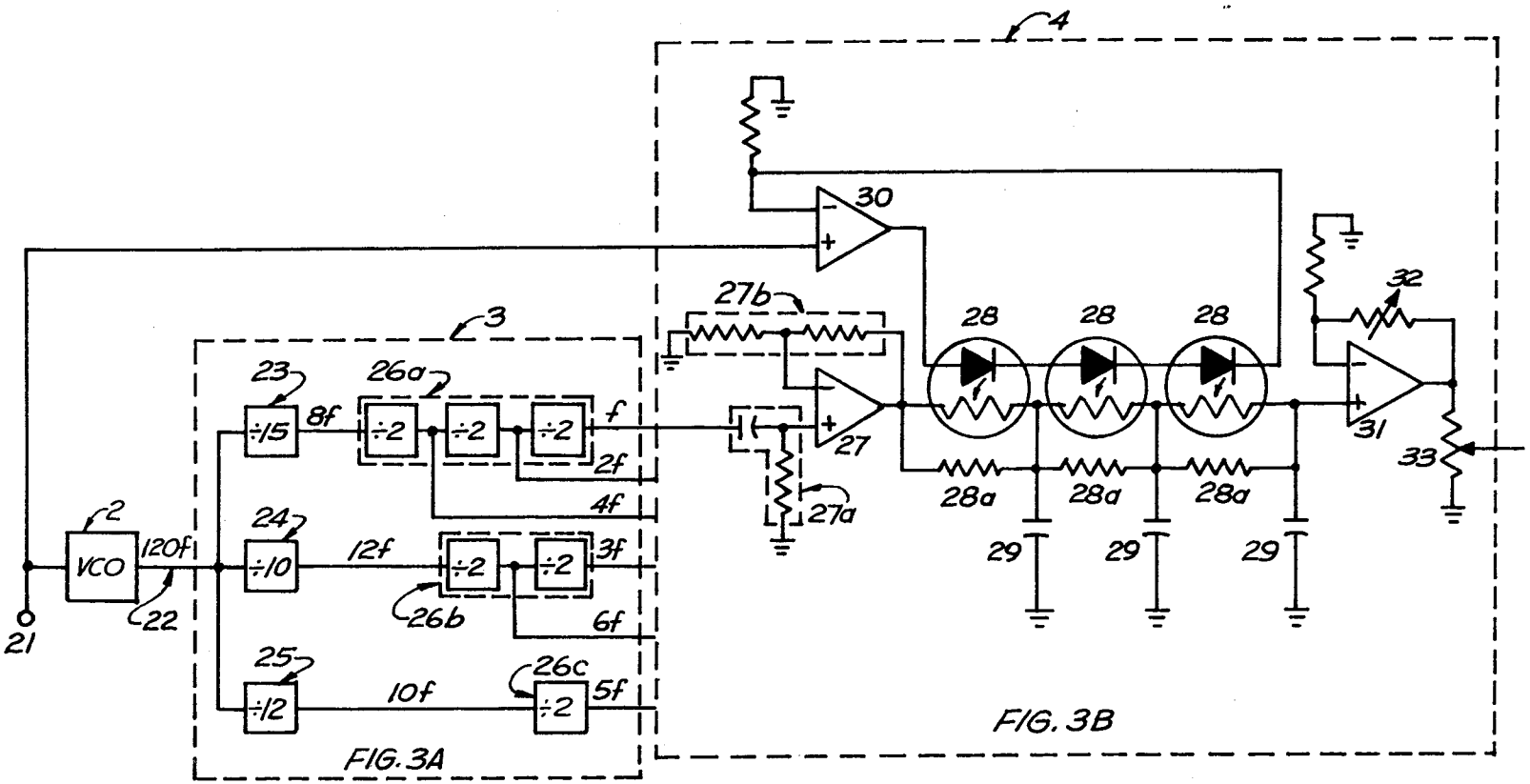
FIG. 3 is a schematic diagram illustrative of means for generating harmonic signals for timbre definition and a representative tracking filter network.

FIG. 3 illustrates the concept of the previous paragraph. Pitchproportional voltage on line 21 is input to VCO 2 designed to produce a pulse train of frequency Nf, where N is an even multiple of all harmonics it is desired to generate and f is the fundamental frequency. Multiple N being even assures a symmetrical output waveform at all harmonics. The case illustrated in FIG. 3 is for generating the fundamental and five overtones, i.e. harmonics one through six. For this case, the VCO is programmed to run at 120*f*. The pulse train at 120*f* appears on line 22 which is input to divider network 3 in which it is routed to three primary dividers 23, 24, and 25. Divider 23, typically a DM8520 integrated circuit, divides the input pulse train by 15, producing an output pulse train at 8f which is further divided by a series of binaries 26*a*, typically sections of a SN7493 integrated circuit, to produce symmetrical square-wave signals at 4f, 2f and the fundamental frequency, f. The second divider 24, typically a SN7490 integrated circuit, divides the pulse train 22 by 10, producing an output pulse train at 12*f* which is further divided by binaries 26*b* to produce symmetrical square-wave signals at 6*f* and 3*f*. Finally, divider 25, typically a SN7492, divides pulse train 22 by 12, producing an output pulse train at 10f which is divided by a binary 26c to produce a symmetrical square-wave signal at 5f, completing the series of six harmonics. The preceding circuit is illustrative of the method of this invention. More or fewer harmonics may be generated using the same design procedure. For example, a system to generate the first eight harmonics would employ a VCO operated at 1680f which would be divided by 1680, 840, 560, 420, 336, 280, 240, and 210 to produce symmetrical squarewave signals at f, 2f, 3f, 4f, 5f, 6f, 7f, and 8f, respectively.

Outputs of the divider network then pass to a number of tracking filters 4 (FIG. 3 B) where the symmetrical square-wave or pulse signals are filtered to produce low-distortion sine waves at the same input frequency. FIG. 3 B shows a representative one of these tracking filters, in this case the filter for the fundamental frequency, f. Actually there is a separate filter for each of the harmonics, but each has the same circuit so just one is shown for simplicity. Referring to FIG. 3 B, the signal f is amplified by amplifier 27 to produce a high level (typically 20v. peak-to-peak) signal. The input circuit is capacitively coupled to block the average D-C level of the digital signal and to limit the low frequency response of the filter to the useful limit of the filter. The filter network is a three-stage RC low-pass filter comprising resistance elements (which are the photoresistors in optical isolators 28) and fixed capacitors 29. Optical isolators 28 comprise a photoresistor and a light-emitting diode (or other light source) in a light-tight enclosure. The photoresistor is designed using a material, such as CdS, to have a characteristic function which makes the resistance of this element inversely proportional to the light incident on it. The light-emitting diode (LED) of the optical isolator has a characteristic which makes its light output proportional to the current through it. Thus, if the current through the LED's of the filter can be made proportional to the frequency of the input signal f, the frequency characteristic of the filter will be normalized, i.e. the relative attenuation of the higher frequency components of the input signal will remain constant despite change in input frequency. This is a necessary circumstance to achieve the object of this invention of maintaining a constant volume of output irrespective of pitch. It is also a necessary circumstance to achieve the object of maintaining a constant preset timbre over the full compass of the keyboard. Preferably, the filter input is a symmetrical square wave, which can be shown by Fourier analysis to contain frequency components comprising only odd harmonics. Thus an effective filter to obtain the fundamental sine wave component is a low-pass filter. The three-section low-pass filter of the present invention is capable of reducing the harmonic content of the input to approximately 1% of the fundamental, practically inaudible even to a trained ear. Of course this filtering procedure is done at the expense of signal amplitude, the output sine wave being about 50mv. pk-to-pk. compared to the 20v. pk-to-pk. input. Amplifier 31 restores the signal level to about 0.5v. Gain-determining rheostat 32 is used to adjust the output level to a value common to all tracking filters. Potentiometer 33 is employed to provide a calibrated measure of the contribution of the given harmonic sine wave to the timbre of the resultant tone. Amplifier 30 provides a current flow through the series-connected LED's of the optical isolators 28 which is directly proportional to the pitch-proportional voltage on line 21, thus achieving the normalization of the filter response with frequency.

The degree to which the performance of the aforementioned tracking filter achieves the ideal of true reciprocity of resistance with frequency is discussed below. An optical isolator with approximately the required characteristics is the type VTL 5C3, or the dual-element type VTL 5C3/2 manufactured by Vactec, Inc., Maryland Heights, Mo. I have determined that the photoresistance of these devices as a function of LED current is closely reciprocal over a current range from 1 to 10 ma., equivalent to a keyboard span of a little more than 3 octaves. I have achieved reciprocity over the range of LED current from 0.2 to 10 ma. by shunting the photoresistor element with a fixed resistance of 200 Kilohms for the VTL 5C3/2 or 250 Kilohms for the VTL 5C3 (Resistor 28a shown in FIG. 3B). With the shunt resistance, reciprocity is excellent over a keyboard span of more than 5 octaves. A three-section low-pass filter of the design in FIG. 3B, element 4, with capacitors 29 having a value of 0.1 microfarad was tested using VTL 5C3/2 optical isolators and was found to produce a low-distortion sine wave from 50 Hz. to 2500 Hz using 200 K-ohm shunt resistors, and an LED current range from 0.2 to 10 ma. The amplitude of the output signal varied no more than ± 1.4 db over the frequency range, an amount virtually inaudible even to the trained ear. Tracking filters for all the harmonics desired to produce a preset timbre are operated over the same LED current range. The capacitors 29 of the filters are sized according to the harmonic being filtered, e.g., the f filter uses 0.1 uf., the 3f filter uses 0.033 uf., etc., thus insuring approximately equal filter outputs and low-distortion sine wave harmonic components. Optical isolators of the type described are preferable to field-effect transistors for this service as filter elements, since FET's must be operated at low signal levels (less than 50 mv.) to avoid distortion and most FET's have a rather limited reciprocal resistance operating characteristic. The photoresistors of the VTL 5C3 have very low voltage coefficients and thus introduce negligible distortion into the signals which pass through them. This characteristic is very important for voltage-controlled amplifiers, as will be discussed later.

Figure 4:
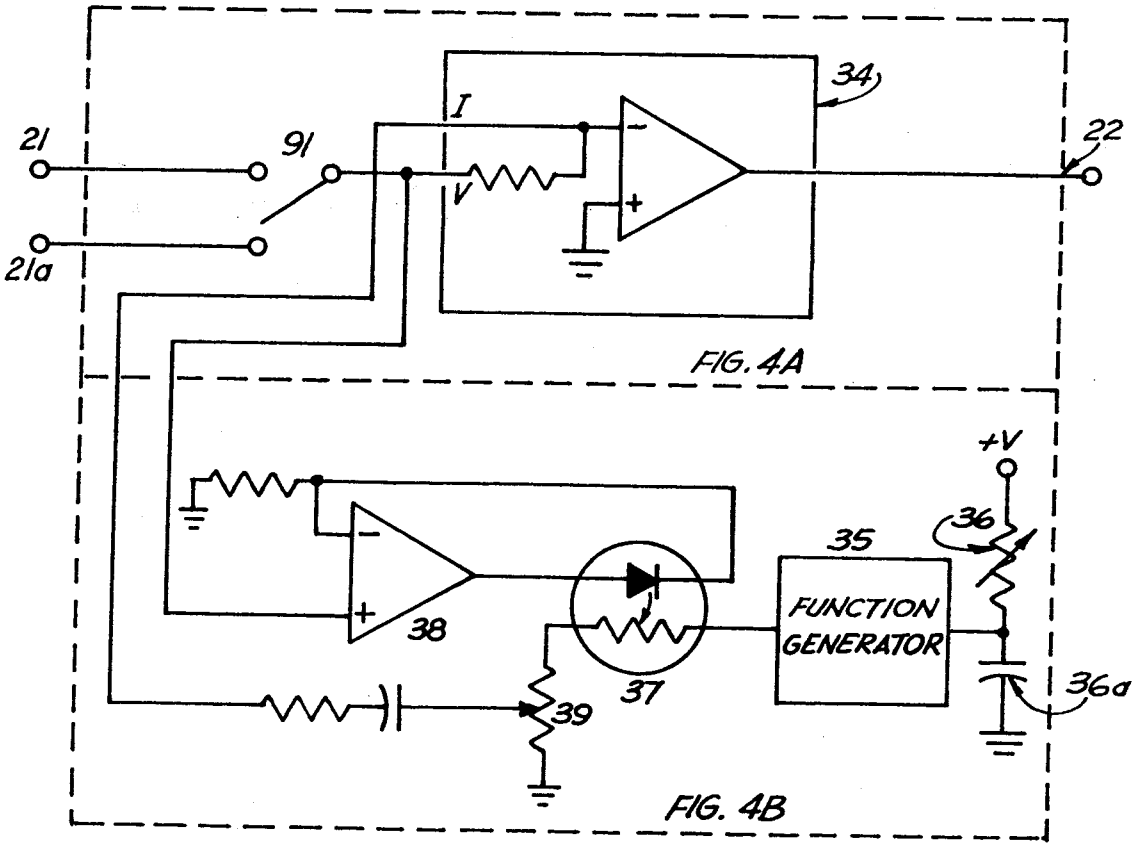
FIG. 4 is a schematic diagram of an improved vibrato circuit for use with this invention.

FIG. 4A illustrates the voltage-controlled oscillator. Referring to FIG. 4, pitch-proportional voltage 21 is voltage input to element 34. Element 34 is a commercially available VCO, type 4705 manufactured by Teledyne Philbrick, Dedham, Mass., which produces a pulse train of 0-1 MHz. when input with 0-10 v. at its V input. Element 34 is also provided with a current (I) input which is used in this invention for the vibrato input.

FIG. 4B illustrates a circuit employing the optical isolator's reciprocal characteristic function, to achieve an improved vibrato effect. A desirable characteristic of vibrato is that of maintaining a preset degree of vibrato in terms of aural tone interval irrespective of the pitch. This requires that the amplitude of frequency swing be maintained a constant percentage of the average frequency. A variable-frequency function generator 35, typically a type XR2307 integrated circuit, produces a triangle-wave output at a rate determined by an external RC network comprising rheostat 36 and a capacitor 36a. These elements are sized to produce an output for 35 at a frequency from 2 to 10 Hz., variable via rheostat 36. Rheostat 36 determines the rate of the vibrato; potentiometer 39 determines the amplitude (depth) of the vibrato. Optical isolator 37 is used to adjust the voltage across potentiometer 39 as a function of the pitch-proportional voltage on line 21. Amplifier 38 converts the voltage on line 21 to a proportional current through the LED of element 37, and as previously described, the photoresistor in 37 varies inversely in value to the LED current. Thus interposing this resistance between the output of function generator 35 and potentiometer 39 causes the signal at the wiper of potentiometer 39 to vary proportionally with voltage 21. The vibrato signal from 39 is routed to VCO element 34 via a DC-blocking capacitor and a fixed resistor to the currentsumming input of 34. In contrast to the precision reciprocal tracking required for the filter circuits previously described, the vibrato application is less critical. Therefore using VTL 5C3 optical isolator as element 37 and a 1000 ohm potentiometer for 39 is satisfactory, the photoresistor of 37 being enough higher in value that it effectively defines the current through the potentiometer 39.

Figure 5:
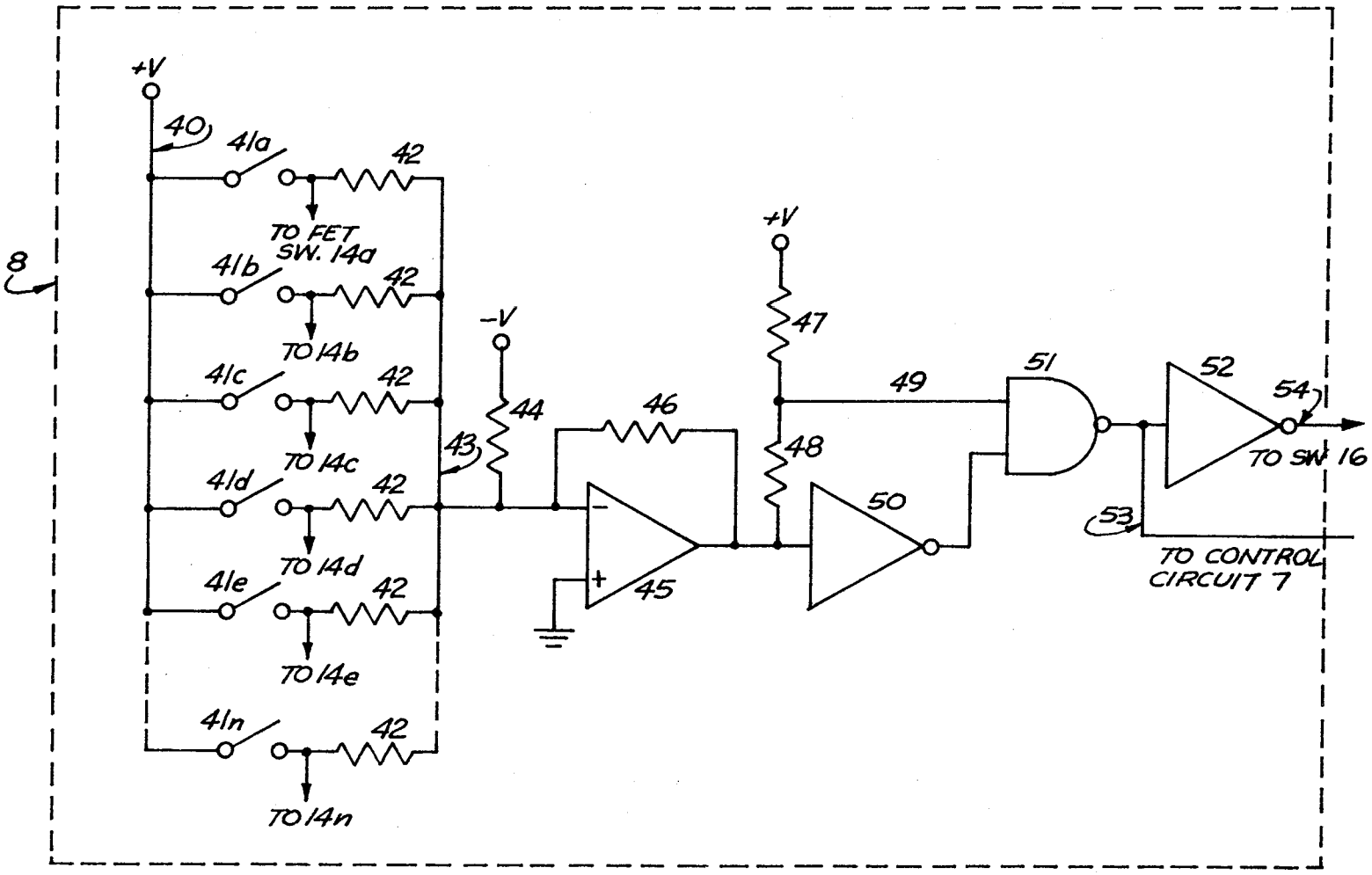
FIG. 5 is a schematic diagram of an electronic interlock against a multiple key depression.

FIG. 5 shows the circuit of a control system 8 for use with a keyboard, its purpose being to provide control signals to the electronic switches of the ladder network described previously with FIG. 2 and to provide a control output pulse only when a single keyswitch is operated. Referring to FIG. 5, a source of voltage +V, typically +15v., is supplied to a bus 40 to which one side of all keyboard switches 41 are connected. Only six keyboard switches are shown for simplicity. The output side of each switch 41 is connected to its corresponding FET switch (FIG. 2) and to one side of a fixed resistor 42, typically 9.1 K-ohms. The output sides of all resistors 42 are connected to bus 43 and to the minus input of amplifier 45. Also connected to the minus input of amplifier 45 is one side of resistor 44, typically 6.8 K-ohms, its other side being connected to a source of voltage −V, typically −15v. With the positive input of amplifier 45 grounded, the minus input becomes a current summing node, the resultant current passing through feedback resistor 46, typically 8.2 K-ohms, such that a voltage is developed at the output of amplifier 45 equal to −8.2K-ohm times the current. Since the minus input terminal of amplifier 45 is maintained at zero potential through feedback, there is no interaction between switches 41 which might cause FET switches 14 to be inadvertently energized. The circuit described thus far achieves an intermediate objective of providing a three-state output from amplifier 45 according to the situations of no key, one key, and two or more keys 41 depressed. The operations are tabulated in the table, and described below.

tors 42, (43), 44, and 46 were selected such that amplifier 45 output could be used to drive complementary MOS digital logic at appropriate "zero" and "one" voltage states. Amplifier 45 output drives the input of CMOS inverter 50 directly, and CMOS two-input NAND gate 51 via a biased resistor divider comprising fixed resistor 48, typically 12K-ohms, fixed resistor 47, typically 9.1 K-ohms, and voltage +V, typically +15v. The divider output, line 49 is connected to one input of NAND gate 51, the other input being the output of inverter 50. The output of gate 51 on line 53 is used by an envelope control circuit to be described later. Inverter 52 will provide a logic "one" on line 54 when one and only one key is pressed as will be seen. When no key is depressed, amplifier 45 output is +12v. which is a logic "one" for inverter 50. Line 49 voltage becomes +13.7v. which is a logic "one" for one input of gate 51. However, since the second gate 51 input is a logic "zero" owing to inverter 50, the output of gate 51 is logic "one" and that of inverter 52 is logic "zero." When one key is depressed, amplifier 45 output is +4.5v., equivalent to a logic "zero." Line 49 voltage becomes +10.5v., a logic "one," and thus gate 51 output goes "low" producing a logic "one" on line 54 which enables switch 16 of FIG. 2, causing the pitch-proportional voltage for that key to be output on line 21. Should two keys be depressed simultaneously, amplifier 45 output drops to −9v., a logic "zero" for inverter 50 input. Line 49 voltage drops to +4.1v., also a logic "zero" for one input of gate 51. Thus the output of gate 51 goes "high" and the output of inverter 52 and line 54 go to logic "zero," disabling switch 16 in FIG. 2.

Figure 6:
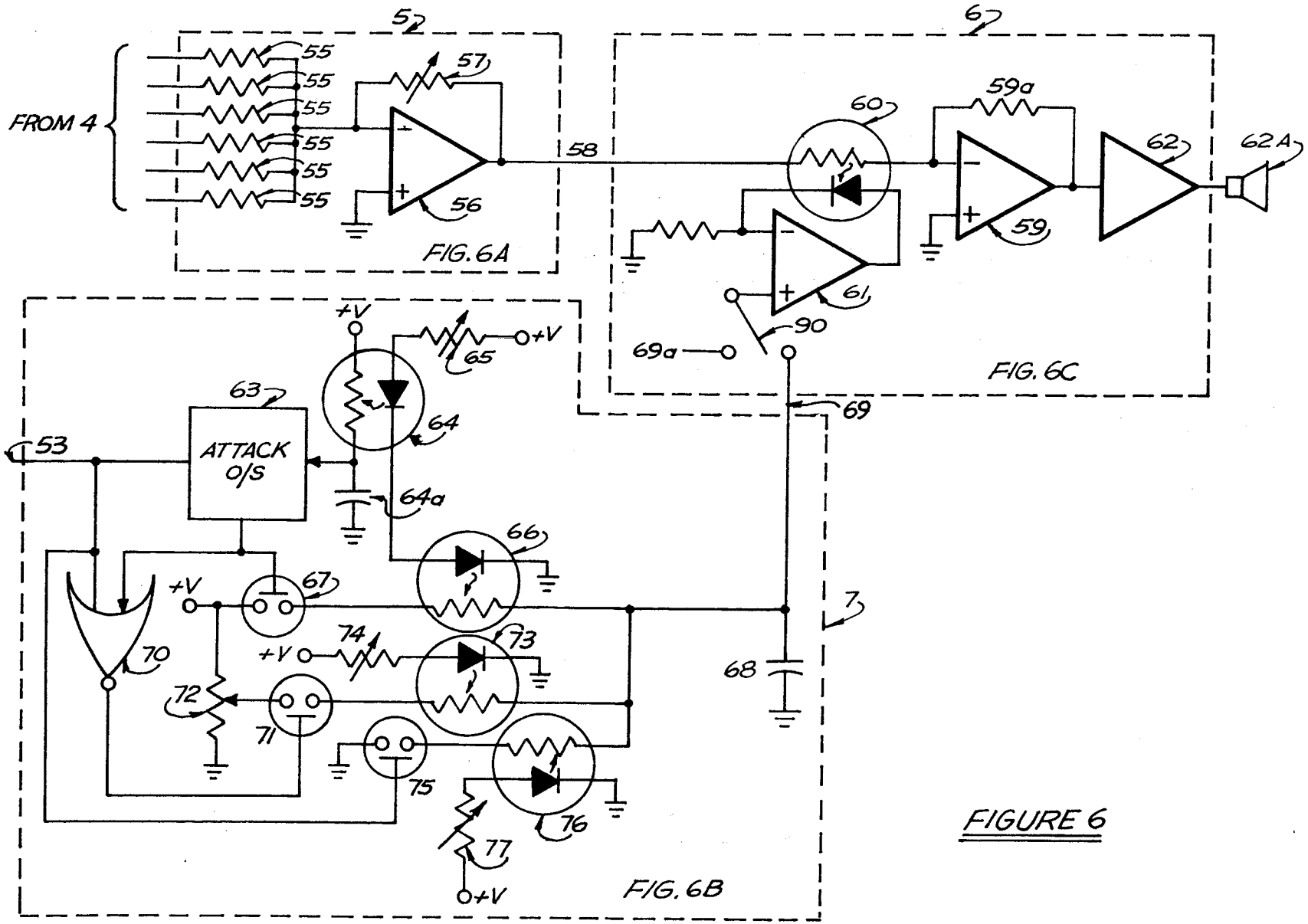
FIG. 6 is a schematic diagram of an envelope control circuit for musical expression.

FIG. 6 shows the interrelationship of the mixer amplifier 5, voltage-controlled amplifier 6, and a source of amplitude-proportional voltage for musical expression 7. The output lines from the tracking filters 4, detailed in FIG. 3, carry the weighted values of the harmonics selected to produce a desired timbre. Each amplitude-weighted, sine-wave voltage harmonic signal is input to amplifier 56 through an input resistor 55. Amplifier 56 sums the input signals and amplifies the sum, now a complex wave of pre-determined timbre, an amount proportional to the value of feedback rheostat 57, used to establish a maximum system volume. The output of amplifier 56 is routed to VCA 6 via line 58. VCA 6 comprises an operational amplifier 59 whose input resistance is the photo-resistor of optical isolator 60, a power amplifier 62, and a voltage-to-current converting amplifier 61 having an input from amplitude-proportional voltage source 7 on line 69. The LED of

KEYING LOGIC

| | Amp. 45 | | Inv. 50 | | NAND 51 | | | Inv. 52 | | Sw. 16 |
|---|---|---|---|---|---|---|---|---|---|---|
| Keying | In | Out | In | Out | $In_1$ | $In_2$ (49) | Out | In (53) | Out (54) | |
| None | −2.2 ma. | +12v | 1 | 0 | 0 | 1 | 1 | 1 | 0 | Open |
| 1 Key | −0.55 ma. | +4.5v | 0 | 1 | 1 | 1 | 0 | 0 | 1 | Closed |
| 2 Keys | +1.1 ma. | −9v | 0 | 1 | 1 | 0 | 1 | 1 | 0 | Open |
| 3+Keys | +2.7+ma. | −12v | 0 | 1 | 1 | 0 | 1 | 1 | 0 | Open |

When no key is depressed, current flow to amplifier 45 is exclusively from resistor 44 and −V. This produces an output voltage from amplifier 45 of about +12v., its limit. When two keys are depressed, amplifier 45 output becomes −9.0v. More than two keys depressed simultaneously will result in the amplifier 45 output to reach a limit at about −12v. Values of resisoptical isolator 60 is supplied a current proportional to the voltage on line 69 via amplifier 61. As previously explained the photoresistance of isolator 60 is inversely proportional to the LED current. Since the gain of amplifier 59 is determined by the ratio of feedback resistance 59*a* to input resistance, the gain of amplifier 59 will thus be proportional to the LED current and the voltage on line 69. Optical isolator 60 is preferably a Vactec type VTL 5C3. In this service, reciprocity of photoresistance with LED current is secondary to having a photoresistor with low voltage coefficient and rapid response time to variations in LED current. Rapid response time is needed to impart a wide variety of expression to the output sound, e.g. the rapid attack of a plucked string.

Circuit 7 (FIG. 6B) illustrates a circuit for providing signal amplitude envelope control signals for the VCA 6. Circuit 7 develops a gain-control voltage by selectively charging and discharging a capacitor 68 in response to a logic control signal 53 indicating a single keystroke. The circuit shown provides four stages of amplitude control: an attack stage where the control voltage rises exponentially to a maximum; a decay stage where the capacitor discharges exponentially to a fixed voltage; a sustain stage where the last-mentioned voltage is held for the duration of the single key depression; and a release stage where the capacitor is discharged to zero potential exponentially. As shown, circuit 7 employs several photoresistor/LED optical isolators of the VTL 5C3 type, although single or ganged rheostats would also suffice instead. As mentioned in the discussion of FIG. 5, a logic pulse which goes to "low" state for a single keystroke is available from gate 51 and output on line 53. Line 53 is input to a "one-shot" element 63, typically a type NE 555 integrated circuit, which produces a positive pulse of duration determined by the photoresistor of isolator 64 and a fixed capacitor **64*a* connected thereto. So that the attack time period and charging rate for the capacitor 68 be commensurate, current for the one-shot isolator 64 LED and the attack charging isolator 66 LED is the same by virtue of their series connection, a variable current being provided by rheostat 65 and voltage source +V. The one-shot fixed timing capacitor 64*a* is sized to be about twice the value of capacitor 68 so that capacitor 68 can acquire a voltage close to the supply voltage +V when this voltage is switched to the photoresistor of isolator 66 via FET switch 67, energized for the period defined by one-shot 63. Capacitor 68 charges toward +V at a rate determined by the photoresistance of optical isolator 66 and its value, typically 0.5 uf., when switch 67, typically one section of an RCA CD4016, is energized by one-shot 63. When one-shot 63 "times out", switch 67 is deenergized, and the circuit operates in the "decay" mode. If the key continues to be pressed, FET switch 71 is energized by the logic "high" output of NOR gate 70. NOR gate 70 will only produce a logic "high" output when both its inputs are "low," a situation which can exist only if line 53 is "low," indicating that a single key is depressed, and one-shot 63 output is "low" indicating that the attack period is over. Potentiometer 72 provides an input to switch 71 which is a fraction of +V; thus, when switch 71 is energized, capacitor 68 discharges through photoresistance of optical isolator 73 and switch 71 to the voltage established at the wiper of potentiometer 72. If the key continues to be depressed, the voltage on capacitor 68 will remain at this value; thus potentiometer 72 is called the "sustain" potentiometer. When the key is released, line 53 goes to a logic "high" level, energizing switch 75 which discharges capacitor 68 to zero potential through the photoresistance of optical isolator 76. The discharging resistance is determined by the current through the LED of isolator 76 defined by rheostat 77 and source +V. The operator thus can effect a wide variety of musical expression via the attack control, rheostat 65, the decay control, rheostat 74, the sustain level control, potentiometer 72, and the release control, rheostat 77,** in addition to the period that a key is depressed.

Figure 7:
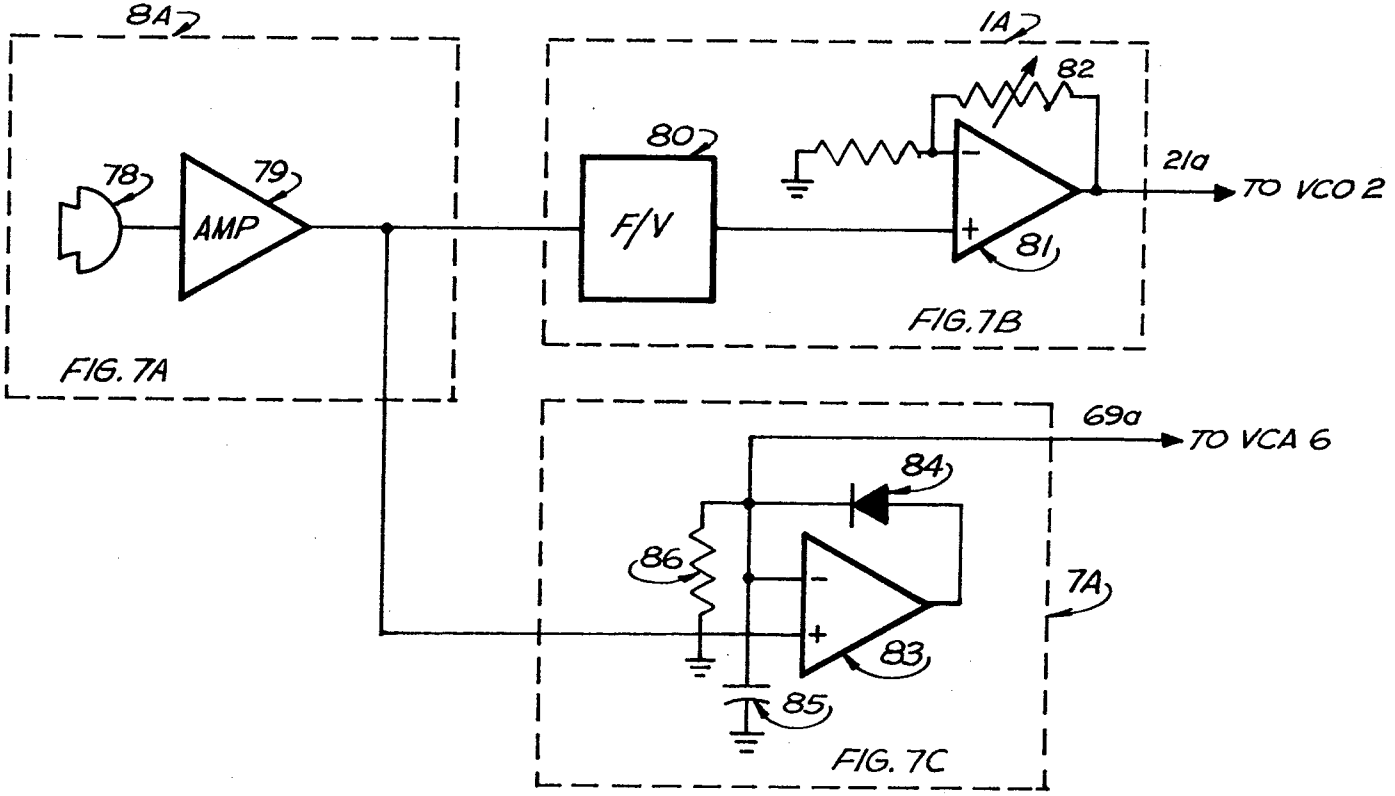
FIG. 7 is a diagram of the amplitude sensing and frequency translating system for use of the present invention with electrical signals from an outside agency.

FIG. 7 illustrates alternate means for control, pitch-proportional voltage generation, and amplitude-proportional voltage generation for use in this invention when it is desired to modify the pitch and timbre of another signal source. For example, it may be desirable to have this invention provide accompaniment to another instrument in proportional pitch, e.g. musical "thirds, " but with contrasting timbre. Referring to FIG. 7, control element 8A of FIG. 74 comprises a source of signal pickup 78, shown schematically as a microphone, and a signal amplifier 79.

The output of amplifier 79 is routed to element FIG. 7B for extraction of pitch information, and to element FIG. 7C, for extraction of amplitude information. The elements in FIG. 7B comprises a conventional frequency-to-voltage converter 80, typically a type 4702 module manufactured by Teledyne-Philbrick, Inc., and a voltage amplifier 81. F/V converter 80 samples the signal output of amplifier 79, produces a train of pulses at the signal input fundamental frequency, and filters these pulses to obtain a D-C voltage proportional to the signal input frequency. The type 4702 produces an output of 0-10 volts for an input of 0-10 KHz. Amplifier 81 receives as input the output of F/V element 80 and via gain-controlling rheostat 82, produces a pitch-proportional output voltage on line **21*a* which is routed to VCO 2, previously described via double-throw switching means 91, (FIG. 4*A*) not further described. Rheostat 82** allows the operator to "tune" the output pitch of this invention either to match, or to maintain a specific musical interval (ratio) with the input signal pitch. Timbre selection for the reconstituted signal is the same as previously described.

The output of amplifier 79, containing amplitude information proportional to the input signal, is also input to element FIG. 7C which comprises a peak-detecting circuit of conventional design, producing a volume-control circuit for the synthesizer. Amplifier 83 is a differential operational amplifier used to charge capacitor 85 to the positive peak voltages of the input signal via diode 84. When the voltage across capacitor 85 is less than the input voltage, amplifier 83's output switches rapidly to about +12v., forward-biasing diode 84, and causing 84 to conduct a current which charges capacitor 85 until its voltage equals the input voltage. If the signal input voltage falls below the voltage across capacitor 85, amplifier 83 switches to −12v., back-biasing diode 84; thus the charge on capacitor 85 remains at the previous positive peak input voltage. Resistor 86 is provided to leak the charge off capacitor 85 at a preset rate such that the circuit will provide an output on line **69*a* which generally follows the envelope of the voltage input. Line 69*a* is routed to VCA FIG. 6, previously described, connecting to amplifier 61 instead of line 69 through a double-throw switching means 90, not further described. Circuit values for capacitor 85 and resistor 86 depend on the desired rate at which the input signal amplitude is to be tracked. Small values will provide tracking on a cycle-to-cycle basis, larger values will average over many cycles. A further limit on the rate at which capacitor 85 can acquire the peak value of the input can be obtained via a resistor interposed between the output of amplifier 83 and the anode of diode 84.**

While I have described and illustrated specific embodiments of my invention, it is clear that variations of the details of construction which are specifically illustrated and described may be resorted to without departing from the spirit and scope of the invention as defined in the appended claims.

What I claim is:

1. In a music synthesis apparatus having associated music signal utilization means, the improvement comprising in combination, a. a source of variable control voltage, b. at least one voltage controlled oscillator receiving input voltage from said source, each oscillator generating an output signal of frequency that is a multiple of each and every one of the harmonics desired in the synthesizer output, said frequency being varied by the said variable voltage source, c. digital dividing means receiving input from said oscillator, and producing pulsating signals as output on separate harmonic output lines for each of the said harmonics, each signal having a repetition frequency equal to that of the desired harmonic, d. individual tracking filter means each receiving input signal from one of said harmonic output lines, and converting its input signal into an output sine wave of the same fundamental frequency, each said tracking filter means being provided with tuning means responsive to an input of control voltage whereby the filtration characteristic of each tracking filter means may be tuned over the range of frequency of its input signal, the said control voltage being tapped from the output of the aforesaid control voltage source, e. mixing means providing for preselection of any desired fraction of the signal strength of the sine wave output from each said tracking filter means, and for summing all such preselected fractions, f. voltage control means operable to select a particular voltage at the said voltage source, and to apply said particular voltage as input to the said voltage controlled oscillator.

2. In a music synthesizer according to claim 1 for generating tones having a frequency relationship wherein an octave is subdivided into any preselected number, *n*, of equitempered intervals, in which the ratios of the frequency of the upper note of each interval to the frequency of the lower note of the said interval are equal for all intervals, to $2^{-l/n}$, and using as signal generating means a voltage controlled oscillator with proportional characteristic between input voltage and output frequency, the improved pitch-proportional voltage source comprising:

a. a constant voltage source, b. a ladder network attenuator extending between the terminals of said voltage source, with the L-step on the ladder network for each interval of the desired musical scale, c. the series resistors of all steps having a normalized resistance value of unity, d. the terminating shunt resistor having a normalized resistance value, $R_t$, of $1/(2^{l/n} - 1)$, e. the shunt resistors of each of the higher steps each having a normalized resistance value $R_1$, equal to $(R_t + R_t^2)$, and f. switching means to connect any desired ladder step to the voltage-controlled oscillator input.

3. A music synthesizer according to claim 2 for use with the common 12-note equitempered musical scale, wherein the pitch-proportional voltage source has a ladder network with a. series resistors having normalized resistance of unity, b. a terminating shunt resistor of normalized resistance, $R_t$, equal to $1/(2^{1/12} - 1)$, c. shunt resistors in each higher step of normalized resistance, $R_1$, equal to $(R_t + R_t^2)$.

4. A music synthesizer according to claim 3 having an improved pitch-proportional voltage source with a ladder network having series resistors with normalized resistance of unity, terminating shunt resistors with normalized resistance of 16.817, and shunt resistors at each higher ladder step with normalized resistance of 300.

5. In a music synthesizer according to claim 1, individual tracking filter means for each harmonic comprising a. a low-pass filter of series resistors and shunt capacitors in which each series resistor has a resistance that is variable in response to an outside control signal, and b. conversion means providing said control signal in proportion to the control voltage from the aforesaid control voltage source.

6. Tracking filter means according to claim 5 in which a. the said series resistors are photo-sensitive resistors, and b. receiving light from light emitters powered by current output from voltage-to-current amplifiers with input voltage from said control voltage source.

7. Tracking filter means according to claim 6 in which the photoresistors are operatively packaged with light-emitting diodes in a manner to make each photoresistor's resistance reciprocally related to the current through the light emitting diode.

8. Tracking filter means according to claim 5 in which a. the said low pass filter means comprises photoresistors in series, each photoresistor being shunted to ground with a shunt capacitance, b. their photoemitters being connected also in series, and being fed with current output from a voltage-proportional voltage-to-current amplifier as the said conversion means.

9. A music synthesizer according to claim 2, in which the said switching means comprises one electronic switch for each ladder step, each electronic switch being controlled by a corresponding mechanical switch of a music keyboard, and output sides of all said electronic switches being connected to a common keying bus.

10. In the music synthesizer of claim 9 the combination of logic means to develop an output signal when, and only when, a single keyboard switch is depressed, comprising in tandem a. keyboard switches that are single-pole, and closed when the key is depressed, and have a common input, b. an individual isolating load resistor connected on one side to the output terminal of each switch, and on the resistor's other side to a common bus for all said resistors c. amplifier means with its input connected to said bus and developing output voltages corresponding to the states of (1) no key depressed (2) one key depressed (3) two and more keys depressed, d. a logic inverter device fed by said amplifier and feeding into one input connection of e. a two-input NAND gate, the other input being fed by a voltage-divided fraction of said amplifier output, the NAND gate feeding into f. a second logic inverter device, the output of which is operatively connected to an electronic switch between said keying bus and the voltage-controlled oscillator input.

11. A music synthesis apparatus according to claim 1, including as an element of the source of variable voltage a vibrato-inducing means comprising a. an oscillator producing oscillations of predetermined adjustable vibrato frequency delivering an adjustable fraction of its output as a fluctuating voltage summed with the aforesaid variable control voltage fed to the input of the voltage controlled oscillator, said delivering taking place through b. the photoresistor of an optical isolator, the photoemitter of said isolator being powered with current derived from c. a proportional voltage-to-current amplifier receiving its input from the aforesaid variable control voltage.

12. A music synthesis apparatus according to claim 1, in which the voltage and power amplification system includes a volume controlling photoresistor, which is an element of an optical isolator, the photoemitter of which is powered by expression-control means, comprising in parallel a. attack control means responsive to the initiation of said voltage control means b. decay control means responsive to completion of operation of the attack control means c. sustain means responsive to completion of operation of the decay control means, and d. release control means responsive to the disconnecting of said voltage control means.

13. The apparatus of claim 12, comprising a. a voltage source, feeding through attack, decay, sustain and release timing means, to power said volume-controlling photoresistor and to charge b. an expression timing capacitor, said volume controlling resistor and capacitor receiving their power through c. an attack switch, the attack switch being closed by closure of a keyboard switch, and opened by d. an attack-time timer means, and through e. an attack-rate controlling rheostat, f. a sustain-level potentiometer connected across said voltage source enabling preselection of a fraction of said voltage as a sustain level, g. a decay-initiation switch closed by said attack-timer means at the end of its timing period, and connecting the sustain-level potentiometer through a decay-rate controlling rheostat to the expression-timing capacitor, and h. a release switch closed by opening of said keyboard switch and connected through a release-rate rheostat between ground and the said expression timing capacitor.

14. A music synthesizer according to claim 1, in which the source of variable control voltage comprises in combination a. signal pickup means, operative to transform an external signal into a fluctuating voltage, feeding to b. frequency-to-voltage converter means, operative to produce output signals of varying voltage corresponding to the frequency variations in the external signal c. time averaging volume-control means, fed from said external signal pickup means, and operative to control the said voltage-and-power amplification means.

* * * * *

UNITED STATES PATENT AND TRADEMARK OFFICE

CERTIFICATE OF CORRECTION

PATENT NO. : 3,986,426

DATED : October 19, 1976

INVENTOR(S) : Mark Edwin Faulhaber

It is certified that error appears in the above-identified patent and that said Letters Patent are hereby corrected as shown below:

| Column | Line | As Printed | To be read |
|---|---|---|---|
| 4 | 28 | $1 \sqrt{12 \quad 2}$ | $1 / \sqrt[12]{2}$ |
| 4 | 35 | $1 \sqrt{11 \quad 2}$ | $1 / \sqrt[11]{2}$ |
| 4 | 36 | $1 \sqrt{n \quad 2}$ | $1 / \sqrt[n]{2}$ |
| 4 | 37 | $2^{-\ell/n}$ | $2^{-1/n}$ |
| 5 | 14 | $1 \sqrt{n \quad 2}$ | $1 / \sqrt[n]{2}$ |
| 5 | 14 | $12^{\ell/n}$ | $2^{-1/n}$ |
| 5 | 15 | $= 1/ 2^{\ell/n}$ | $= 1/ 2^{1/n}$ |
| 5 | 16 | $2^{\ell/n}$ | $2^{1/n}$ |
| 10 | 1 | (43) | Delete |
| 12 | 14 | FIG. 74 | FIG. 7A |
| 13 | 50 | $2^{-\ell/n}$ | $2^{1/n}$ |
| 13 | 63 | $2^{\ell/n}$ | $2^{1/n}$ |

Front Page, Item 76, Chatham, Wilmington, Del., 19810 should read: Wilmington, Del., 19803

Signed and Sealed this

Eighth Day of March 1977

[SEAL]

*Attest:*

RUTH C. MASON
*Attesting Officer*

C. MARSHALL DANN
*Commissioner of Patents and Trademarks*